United States Patent [19]

Pasquarello

[11] 4,216,551

[45] Aug. 12, 1980

[54] SHAMPOO APPARATUS

[76] Inventor: Edward J. Pasquarello, 5 Silvermine Rd., Woburn, Mass. 01801

[21] Appl. No.: 9,102

[22] Filed: Feb. 5, 1979

[51] Int. Cl.[2] ..... A45D 19/00; A47K 3/12; A61H 35/00

[52] U.S. Cl. ..... 4/521

[58] Field of Search ..... 4/159, 157, 166–169, 4/187 R, 188, 185 R, 185 HB, 173 R; 128/295; D23/64; D28/20

[56] References Cited

U.S. PATENT DOCUMENTS

| | | | |
|---|---|---|---|
| 2,301,486 | 11/1942 | Weilerstein | 4/159 |
| 2,521,389 | 9/1950 | McClure | 4/159 |
| 2,600,392 | 6/1952 | Cancell | 4/159 |
| 2,600,557 | 6/1952 | Marriott | 4/159 X |
| 2,818,585 | 1/1958 | Campbell | 4/159 X |
| 3,100,898 | 8/1963 | Wade | 4/159 |
| 4,014,054 | 3/1977 | Pasquarello | 4/159 |
| 4,081,867 | 4/1978 | Simeola | 4/159 |

FOREIGN PATENT DOCUMENTS

| | | | |
|---|---|---|---|
| 1457399 | 4/1969 | Fed. Rep. of Germany | 4/159 |

*Primary Examiner*—Stuart S. Levy
*Attorney, Agent, or Firm*—William Nitkin

[57] ABSTRACT

Disclosed is an improved shampoo tray device of the type having a tray with neck receiving aperture and side ridges which tray affixes to the individual being shampooed. The tray includes a first and second side channel formed within the tray extending along the sides of the neck of the user. Seal means are provided for water-tight contact of the tray to the individual's neck as well as a first and second retention strap affixed to the first and second side channels, respectively. The retention straps have a plurality of retention means such as Velcro strips along the length thereof. At least one spray head retention aperture can be defined in a side ridge of the tray adapted for holding a water spay device. Also disclosed is a method for retention of the shampoo tray device of this invention to the user comprising the steps of providing a tray with a first and second retention strap affixed thereto, positioning the tray at the back of the neck of the individual being shampooed and the other end of the tray to where the shampoo water is to be drained, extending the first retention strap over the shoulder of the individual and then around, under the arm and around the back of the individual, extending the second retention strap over the shoulder of the individual and then around, under the arm and around the back of the individual, and affixing the first and second straps together at the back of the individual.

1 Claim, 4 Drawing Figures

SHAMPOO APPARATUS

BACKGROUND OF THE INVENTION

1. Field of the Invention

The apparatus of this invention relates to shampooing devices and more particularly discloses an improved shampooing tray of the type used for the drainage of water from an individual's head being shampooed to a sink, and a method of attaching same to the individual being shampooed.

2. History of the Prior Art

There are many shampooing devices disclosed in the prior art which allow for an individual to sit in an upright position and have water drained from the individual's head while being shampooed into a sink or sink-like apparatus. The present inventor has received U.S. Pat. No. 4,014,054 for such a shampoo device. This patent and the references cited therein are related to the field of the present invention.

Problems have arisen when using the trays of the prior art in holding the tray to the user without discomfort. Some trays have utilized a collar member for attachment which extends around the neck of the individual being shampooed. It has been found that certain individuals such as the elderly and disabled feel the pressure of the collar around their throats due to the weight of the shampooing tray, and such choking pressure becomes uncomfortable thereby making the use of the device inadvisable for these individuals.

SUMMARY

It is an object of this invention to disclose a new and simplified improved design for a shampooing tray as discussed in the prior art above with an improved method and means for attachment of the tray to the individual being shampooed which avoids pressure on the front of the neck.

DETAILED DISCLOSURE

Figure 1:
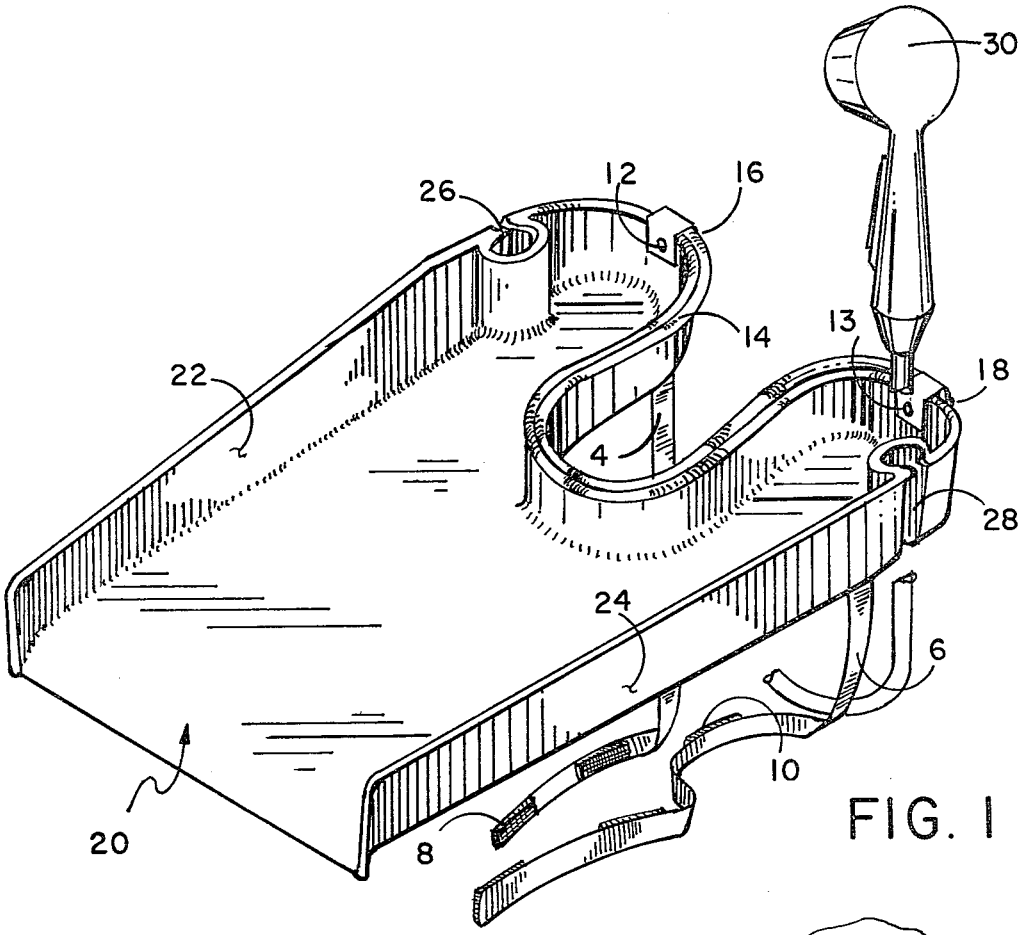
FIG. 1 is a perspective view of the device of this invention.
Figure 2:
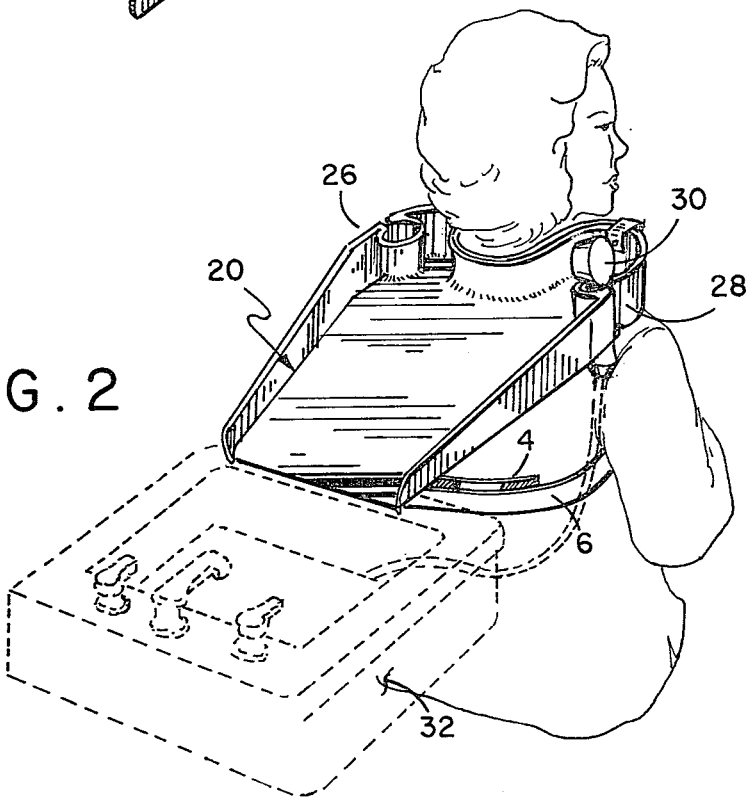
FIG. 2 is a view of the device of this invention in use.
Figure 4:
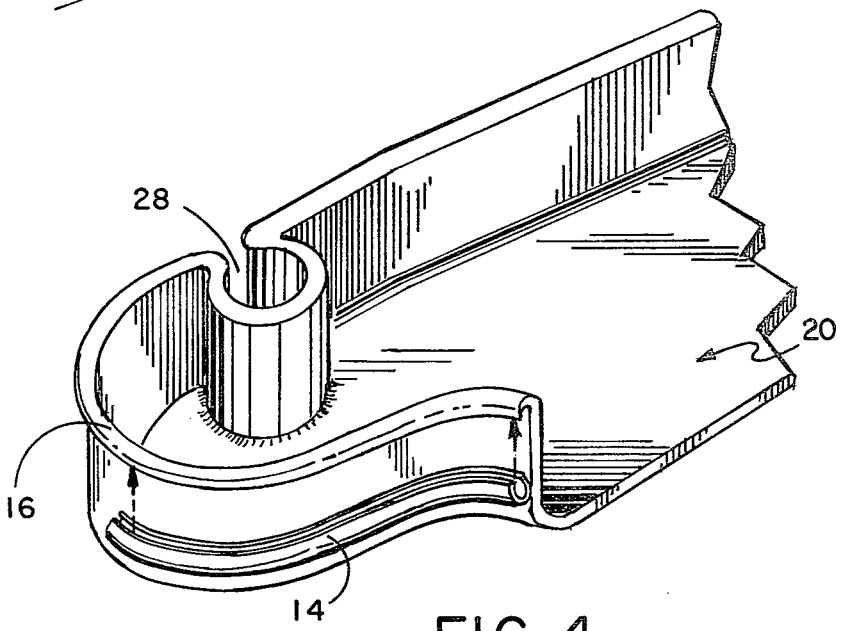
FIG. 4 is a sectional cutaway view through the neck receipt aperture.

FIG. 1 discloses a perspective view of tray 20 of this invention having the water-draining surface with side ridges 22 and 24 to prevent lateral spilling of the water. Along the ridges are defined spray head retention openings 26 and 28 which are adapted to receive and hold a water spray device 30 having a tube which can be attached to the faucet of a sink 32 as shown in FIG. 2. Within the tray is a neck receiving aperture 15 around which is positioned water seal member 14. Such water seal member can be of a compressible material such as rubber, plastic or equivalent. In a preferred embodiment the seal member can fit around a lip formed in the tray as seen in FIG. 4. Further the seal member can extend not only around the neck receiving aperture 15 but also along projections of the tray on either side of the neck receiving aperture forming first and second side channels 17 and 19, respectively. The seal member should be of water-impervious material which when the neck is pressed thereagainst forms a water-tight seal to prevent water from dripping down the back of the neck of the individual being shampooed. Attached at the ends of the first and second side channel are respectively, first and second retention straps 4 and 6. These retention straps can be several feet in length and can be affixed by rivets 12 and 13 or other equivalent means to tray 20. It has been found to be beneficial for the seal means when affixed over a lip 16 of tray 20 to extend around and be bound at its edges by the fold of the retention straps so as to supply additional retention means for seal member 15 to tray 20. Along the first and second retention straps are positioned a plurality of Velcro (a trademark) strips for retention purposes in assisting to hold the tray securely to the user.

Figure 3:
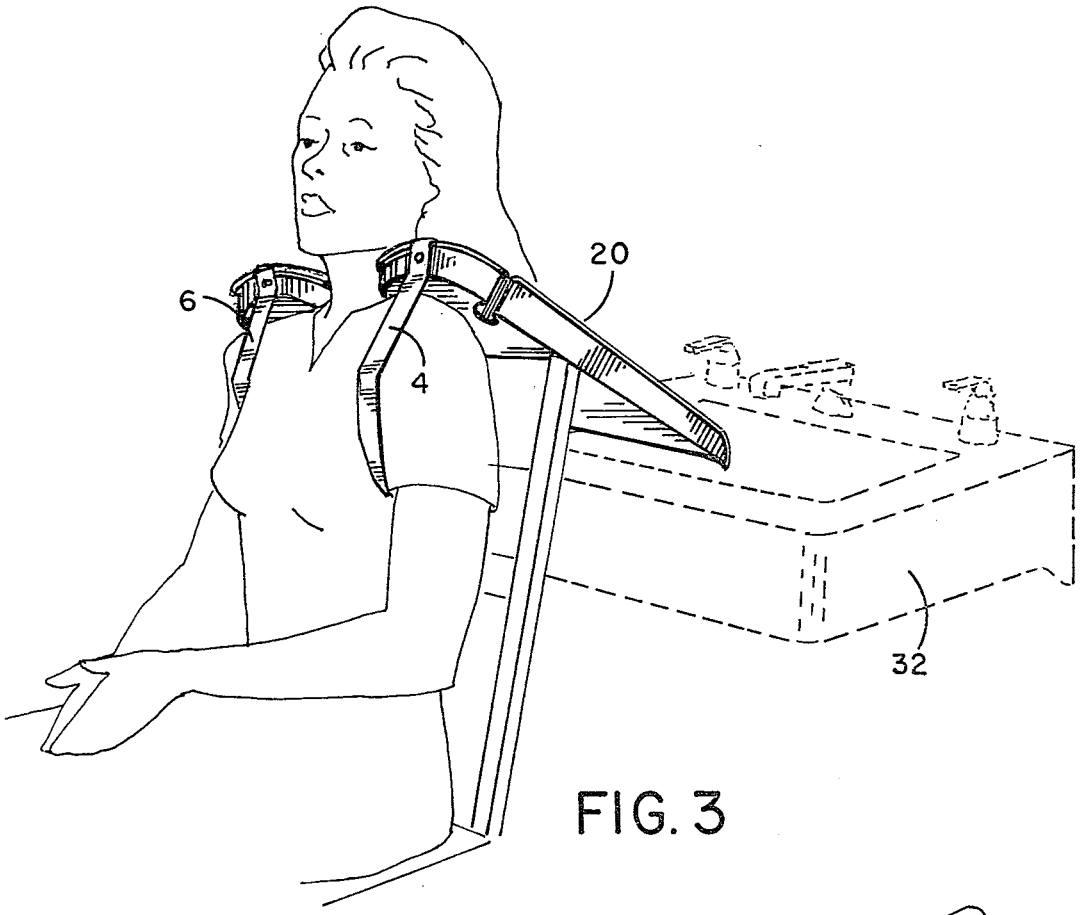
FIG. 3 is a view of the device of this invention in use viewed from the front of an individual utilizing it.

In practice the method disclosed for using the tray is seen in FIGS. 2 and 3. In FIG. 3 one can see the tray resting on the user's shoulders and each strap passing over the front of the individual and down under each arm. In FIG. 2 the straps can be seen coming from under each arm and fastened behind the user by the Velcro or equivalent fastening means. This method of attachment has been found substantially superior to utilizing neck collar affixation means extending around the neck of the user as the method of this invention places the weight of the tray on the shoulders of the user rather than on the front of the neck. The method of this invention has been found useful with elderly persons and also persons confined to wheelchairs or having limited ranges of motion as there is no choking or other discomfort involved.

Although the present invention has been described with reference to particular embodiments, it will be apparent to those skilled in the art that variations and modifications can be substituted therefor without departing from the principles and spirit of the invention.

I claim:

1. An improved shampoo tray device of the type having a tray, a neck receiving aperture, and side ridges, which tray is adapted to be affixed to the individual being shampooed, wherein the improvement comprises:

a first and second side channel formed within the tray and extending along the sides of said neck receiving aperture formed by said raised side ridges extending along the edges of said tray and around said neck receiving aperture;

seal means positioned around said neck receiving aperture adapted for water-tight contact of said tray to the individual's neck;

a first and second retention strap affixed to said first side channel and said second side channel, respectively, said first and second retention straps each having a plurality of retention means comprised of hook and loop materials along the length thereof, said first and second retention straps being affixed around both the edge of the tray at the ends of said first and second side channels and the ends of said seal member for further retention of said seal member to said tray;

a spray head retention opening defined in the side of each channel, each adapted for holding a water spray device;

said shampoo tray adapted for use by positioning said neck receiving aperture of said tray at the rear of the neck of the individual being shampood and positioning the other end of said tray over means for water drainage, extending said first retention strap over the shoulder of the individual and then around and under the arm on the side of the retention strap and around the back of the individual, extending said second retention strap over the shoulder of the individual and then around and under the arm on the side of the retention strap and around the back of the individual, and affixing said first and second retention straps together behind the individual.

* * * * *